US011280075B2

(12) United States Patent
Ferqueron et al.

(10) Patent No.: US 11,280,075 B2
(45) Date of Patent: Mar. 22, 2022

(54) DISPOSAL WITH ABOVE SINK INSTALLATION

(71) Applicant: FB Global Plumbing Group LLC, North Olmsted, OH (US)

(72) Inventors: Russell A. Ferqueron, North Olmsted, OH (US); Kevin A. Lumby, Olmsted Township, OH (US); Eric J. Tonissen, Olmsted Township, OH (US); Mark R. Vogliano, North Royalton, OH (US)

(73) Assignee: FB Global Plumbing Group LLC, North Olmsted, OH (US)

( * ) Notice: Subject to any disclaimer, the term of this patent is extended or adjusted under 35 U.S.C. 154(b) by 172 days.

(21) Appl. No.: 16/776,038

(22) Filed: Jan. 29, 2020

(65) Prior Publication Data

US 2020/0270855 A1 Aug. 27, 2020

Related U.S. Application Data

(60) Provisional application No. 62/798,321, filed on Jan. 29, 2019.

(51) Int. Cl.
*E03C 1/266* (2006.01)

(52) U.S. Cl.
CPC ..... *E03C 1/2665* (2013.01)

(58) Field of Classification Search
CPC ..... E03C 1/2665
USPC ..... 4/286; 241/46.015, 46.014, 46.016
See application file for complete search history.

(56) References Cited

U.S. PATENT DOCUMENTS

| | | | |
|---|---|---|---|
| 2,629,558 | A | 2/1953 | Miller |
| 2,707,080 | A | 4/1955 | Pezzillo |
| 5,236,137 | A | 8/1993 | Coogan |
| 5,560,052 | A | 10/1996 | Ferguson et al. |
| 6,481,652 | B2 | 11/2002 | Strutz et al. |
| 6,508,274 | B2 | 1/2003 | Street |
| 6,588,803 | B2 | 7/2003 | Vila |
| 6,629,652 | B2 | 10/2003 | Batten |
| 6,772,968 | B2 | 8/2004 | Jara-Almonte et al. |
| 6,854,673 | B2 | 2/2005 | Strutz et al. |
| 6,905,360 | B2 | 6/2005 | Berger et al. |
| 6,971,400 | B1 | 12/2005 | Bowman et al. |
| 7,048,213 | B2 | 5/2006 | Strutz et al. |
| 7,264,188 | B2 | 9/2007 | Anderson et al. |

(Continued)

OTHER PUBLICATIONS

International Search Report for International App. No. PCT/US2020/015665 dated Apr. 23, 2020 (2 pages).

(Continued)

*Primary Examiner* — Lori L Baker
(74) *Attorney, Agent, or Firm* — Calfee, Halter & Griswold LLP

(57) ABSTRACT

A disposal with above sink installation where the disposal can be inserted through a drain opening in a basin from above the basin. The disposal includes a housing, a grind assembly, a motor assembly, and a mount assembly. The mount assembly is operable to mount the housing to the drain opening in the basin. The mount assembly includes a flange and a securing mechanism. A diameter of the outer surface of the housing is less than a diameter of the drain opening in the basin. The housing is operable to be inserted through the drain opening in the basin from the top surface of the floor of the basin. The housing is operable to be secured to the drain opening in the basin from the bottom surface of the floor of the basin.

20 Claims, 15 Drawing Sheets

(56) References Cited

U.S. PATENT DOCUMENTS

| | | | |
|---|---|---|---|
| 7,303,299 | B2 | 12/2007 | Theus |
| 7,331,539 | B2 | 2/2008 | Jara-Alamonte et al. |
| 7,337,996 | B2 | 3/2008 | Hanson et al. |
| 7,419,194 | B2 | 9/2008 | Feith |
| 7,448,563 | B2 | 11/2008 | Berger et al. |
| 7,458,108 | B2 | 12/2008 | Wolf |
| 7,533,835 | B2 | 5/2009 | Hanson |
| 7,578,460 | B2 | 8/2009 | Berger |
| 7,584,915 | B2 | 9/2009 | Jara-Almonte et al. |
| 7,607,599 | B2 | 10/2009 | Jara-Almonte et al. |
| 7,665,680 | B2 | 2/2010 | Anderson et al. |
| 7,735,760 | B2 | 6/2010 | Hanson et al. |
| 7,753,297 | B2 | 7/2010 | Hanson et al. |
| 7,815,134 | B2 | 10/2010 | Hohl |
| 7,866,583 | B2 | 1/2011 | Jara-Almonte |
| 7,918,411 | B2 | 4/2011 | Anderson et al. |
| 7,963,469 | B2 | 6/2011 | Hanson |
| 7,971,810 | B2 | 7/2011 | Hirsch et al. |
| 8,033,486 | B2 | 10/2011 | Berger et al. |
| 8,112,823 | B2 | 2/2012 | Dombrowski |
| 8,214,934 | B2 | 7/2012 | Sullivan |
| 8,220,731 | B2 | 7/2012 | Berger et al. |
| 8,579,217 | B2 | 11/2013 | Chesack |
| 8,579,218 | B2 | 11/2013 | Hammer et al. |
| 8,621,683 | B2 | 1/2014 | Coronado et al. |
| 8,646,707 | B2 | 2/2014 | Berger |
| 8,826,505 | B2 | 9/2014 | Dines et al. |
| 8,985,489 | B2 | 3/2015 | Jara-Almonte et al. |
| 9,051,719 | B2 | 6/2015 | Li et al. |
| 9,139,990 | B2 | 9/2015 | Bennage |
| 9,145,666 | B2 | 9/2015 | Hammer |
| 9,267,626 | B2 | 2/2016 | Falcone et al. |
| 9,469,979 | B1 | 10/2016 | Cappa |
| 9,493,935 | B2 | 11/2016 | Walton |
| 9,696,728 | B2 | 7/2017 | Gormley et al. |
| 9,714,505 | B2 | 7/2017 | Kim et al. |
| 9,782,779 | B2 | 10/2017 | Kim et al. |
| 9,815,064 | B2 | 11/2017 | Hirsch et al. |
| 9,827,657 | B1 | 11/2017 | Nelson |
| 9,968,940 | B2 | 5/2018 | Hartmann et al. |
| 10,016,883 | B1 | 7/2018 | Heaton |
| 10,035,150 | B2 | 7/2018 | Gormely et al. |
| 10,053,843 | B2 | 8/2018 | Walton |
| 10,065,299 | B2 | 9/2018 | Shields |
| 10,066,377 | B2 | 9/2018 | Kim et al. |
| 10,159,986 | B2 | 12/2018 | Lee et al. |
| 10,196,802 | B2 | 2/2019 | Park et al. |
| 10,399,088 | B2 | 9/2019 | Chesack |
| 10,407,884 | B2 | 9/2019 | Hirsch |
| 2010/0276526 | A1 | 11/2010 | Shin-Ya |
| 2015/0231639 | A1 | 8/2015 | Kim et al. |
| 2015/0267386 | A1 | 9/2015 | Bewley, Jr. et al. |
| 2015/0369471 | A1 | 12/2015 | Williams |
| 2016/0122986 | A1 | 5/2016 | Gormley et al. |
| 2016/0215483 | A1 | 7/2016 | Landon |
| 2017/0058499 | A1 | 3/2017 | Walton |
| 2017/0203987 | A1 | 7/2017 | McMahon et al. |
| 2017/0358290 | A1 | 12/2017 | Alberts et al. |
| 2019/0003166 | A1 | 1/2019 | Britto |

OTHER PUBLICATIONS

Written Opinion of the International Searching Authority for International App. No. PCT/US2020/015665 dated Apr. 23, 2020 (11 pages).

DISPOSAL WITH ABOVE SINK INSTALLATION

CROSS-REFERENCE TO RELATED APPLICATION

This application claims the benefit of U.S. Provisional Application No. 62/798,321, filed Jan. 29, 2019, the entire disclosure of which is hereby incorporated by reference.

FIELD

The present invention relates generally to a disposal with above sink installation and, more particularly, to a disposal with above sink installation where the disposal can be inserted through a drain opening in a basin from above the basin.

BACKGROUND

Disposals are known. Known disposals require below sink installation. These disposals have various drawbacks. Consumers desire a disposal that eliminates these drawbacks.

SUMMARY

The present invention provides a disposal with above sink installation where the disposal can be inserted through a drain opening in a basin from above the basin.

In an exemplary embodiment, the disposal includes a housing, a grind assembly, a motor assembly, and a mount assembly. The housing includes an inlet, a grind chamber, a motor chamber, and an outlet. The inlet is operable to fluidly connect to a basin. The basin includes a floor having a drain opening extending therethrough. The floor has a top surface and a bottom surface. The inlet is operable to receive water and waste materials from the basin through the drain opening. The grind chamber is in fluid communication with the inlet. The grind chamber is operable to receive water and waste materials from the inlet. The outlet is in fluid communication with the grind chamber. The outlet is operable to receive water and waste materials from the grind chamber. The outlet is operable to fluidly connect to an outlet pipe of a sewer system. The outlet is operable to deliver water and waste materials from the grind chamber to the outlet pipe. The grind assembly is located in the grind chamber. The grind assembly is operable to grind waste materials in the grind chamber. The motor assembly is located in the motor chamber. The motor assembly is operable to drive the grind assembly. The mount assembly is operable to mount the housing to the drain opening in the basin. The mount assembly includes a flange and a securing mechanism. The flange extends around a portion of the inlet of the housing. The flange is operable to abut or be connected to a portion of the top surface of the floor of the basin. A first portion of the securing mechanism is operable to extend around a portion of an outer surface of the housing. The first portion of the securing mechanism is operable to abut or be connected to a portion of the bottom surface of the floor of the basin. A diameter of the outer surface of the housing is less than a diameter of the drain opening in the basin. The housing is operable to be inserted through the drain opening in the basin from the top surface of the floor of the basin. The housing is operable to be secured to the drain opening in the basin from the bottom surface of the floor of the basin.

In an exemplary embodiment, the disposal includes a housing, a grind assembly, a motor assembly, and a mount assembly. The housing includes an inlet, a grind chamber, a motor chamber, and an outlet. The inlet is operable to fluidly connect to a basin. The basin includes a floor having a drain opening extending therethrough. The floor has a top surface and a bottom surface. The inlet is operable to receive water and waste materials from the basin through the drain opening. The grind chamber is in fluid communication with the inlet. The grind chamber is operable to receive water and waste materials from the inlet. The outlet is in fluid communication with the grind chamber. The outlet is operable to receive water and waste materials from the grind chamber. The outlet is operable to fluidly connect to an outlet pipe of a sewer system. The outlet is operable to deliver water and waste materials from the grind chamber to the outlet pipe. The grind assembly is located in the grind chamber. The grind assembly is operable to grind waste materials in the grind chamber. The motor assembly is located in the motor chamber. The motor assembly is operable to drive the grind assembly. The mount assembly is operable to mount the housing to the drain opening in the basin. The mount assembly includes a flange, a fastener, and an arm. The flange extends around a portion of the inlet of the housing. The flange is operable to abut or be connected to a portion of the top surface of the floor of the basin. The fastener is operable to move or be moved. The arm is operable to be moved. The arm has a first end and a second end. The first end of the arm is operable to be connected to the fastener. When the fastener moves or is moved, the first end of the arm moves until the second end of the arm abuts or is connected to a portion of the bottom surface of the floor of the basin. A diameter of the outer surface of the housing is less than a diameter of the drain opening in the basin. The housing is operable to be inserted through the drain opening in the basin from the top surface of the floor of the basin. The housing is operable to be secured to the drain opening in the basin when the second end of the arm abuts or is connected to the bottom surface of the floor of the basin.

In an exemplary embodiment, the disposal includes a housing, a grind assembly, a motor assembly, and a mount assembly. The housing includes an inlet, a grind chamber, a motor chamber, and an outlet. The inlet is operable to fluidly connect to a basin. The basin includes a floor having a drain opening extending therethrough. The floor has a top surface and a bottom surface. The inlet is operable to receive water and waste materials from the basin through the drain opening. The grind chamber is in fluid communication with the inlet. The grind chamber is operable to receive water and waste materials from the inlet. The outlet is in fluid communication with the grind chamber. The outlet is operable to receive water and waste materials from the grind chamber. The outlet is operable to fluidly connect to an outlet pipe of a sewer system. The outlet is operable to deliver water and waste materials from the grind chamber to the outlet pipe. The grind assembly is located in the grind chamber. The grind assembly is operable to grind waste materials in the grind chamber. The motor assembly is located in the motor chamber. The motor assembly is operable to drive the grind assembly. The mount assembly is operable to mount the housing to the drain opening in the basin. The mount assembly includes a flange and a ring. The flange extends around a portion of the inlet of the housing. The flange is operable to abut or be connected to a portion of the top surface of the floor of the basin. The ring is operable to extend around a portion of an outer surface of the housing. A portion of the ring is operable to abut or be connected to a portion of the bottom surface of the floor of the basin. A diameter of the outer surface of the housing is less than a diameter of the drain opening in the basin. The housing is operable to be inserted through the drain opening in the basin from the top surface of the floor of the basin. The housing is operable to be secured to the drain opening in the basin when the ring abuts or is connected to the bottom surface of the floor of the basin.

BRIEF DESCRIPTION OF THE DRAWINGS

—FIG. 1*a* is a rear elevational view, FIG. 1*b* is a side elevational view, FIG. 1*c* is a top plan view, FIG. 1*d* is a partial cross-sectional view of an upper portion of FIG. 1*b*, and FIG. 1*e* is a full cross-sectional view of FIG. 1*b;*

—FIG. 4*a* is a rear elevational view, FIG. 4*b* is a side elevational view, FIG. 4*c* is a top plan view, and FIG. 4*d* is a partial cross-sectional view of an upper portion of FIG. 4*b;*

DETAILED DESCRIPTION

Figure 1B:
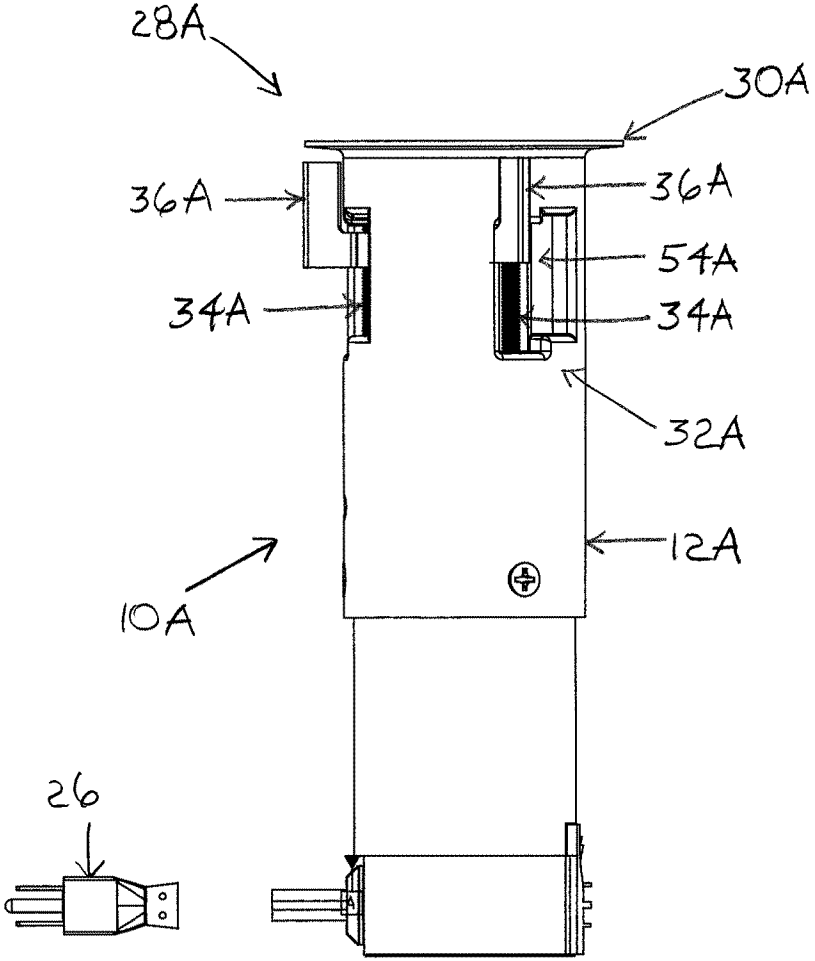
FIGS. 1*a*-1*e* are views of a disposal with above sink installation according to a first exemplary embodiment of the present invention
Figure 1A:
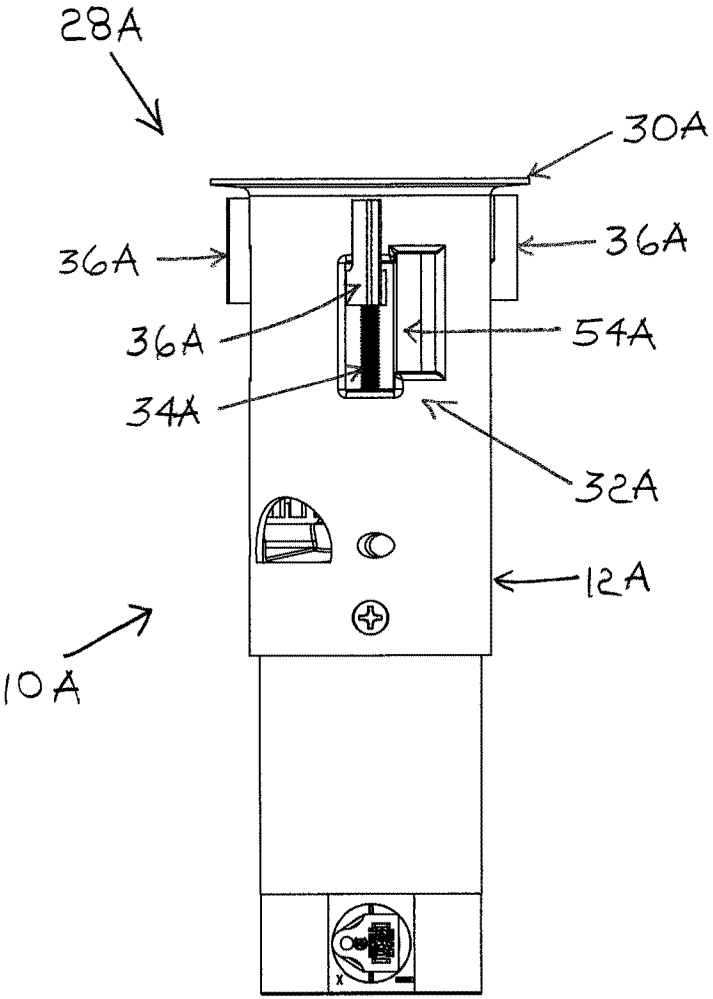
Figure 1D:
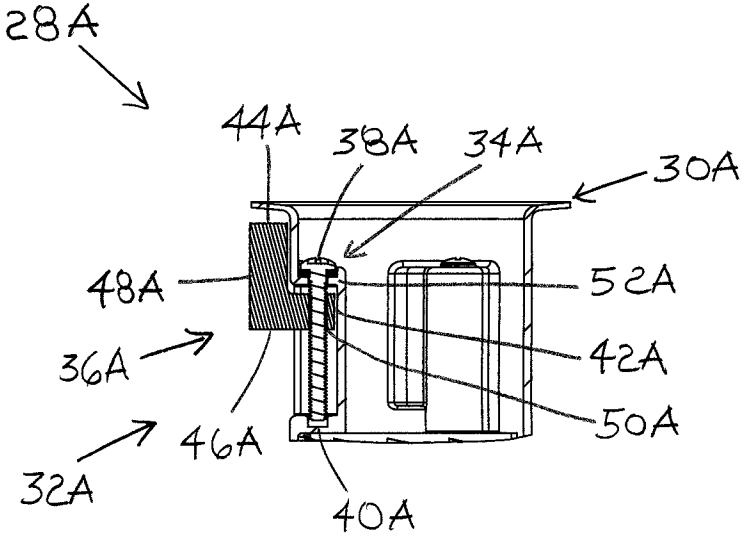
Figure 1C:
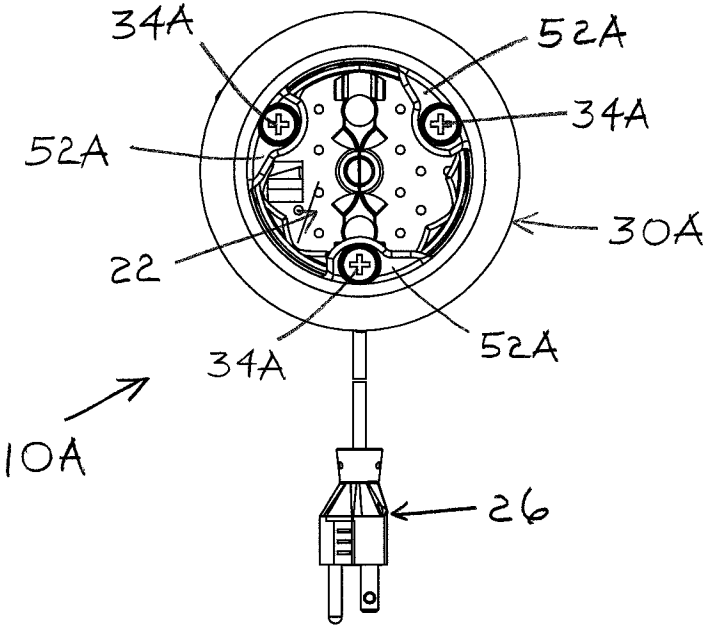
Figure 1E:
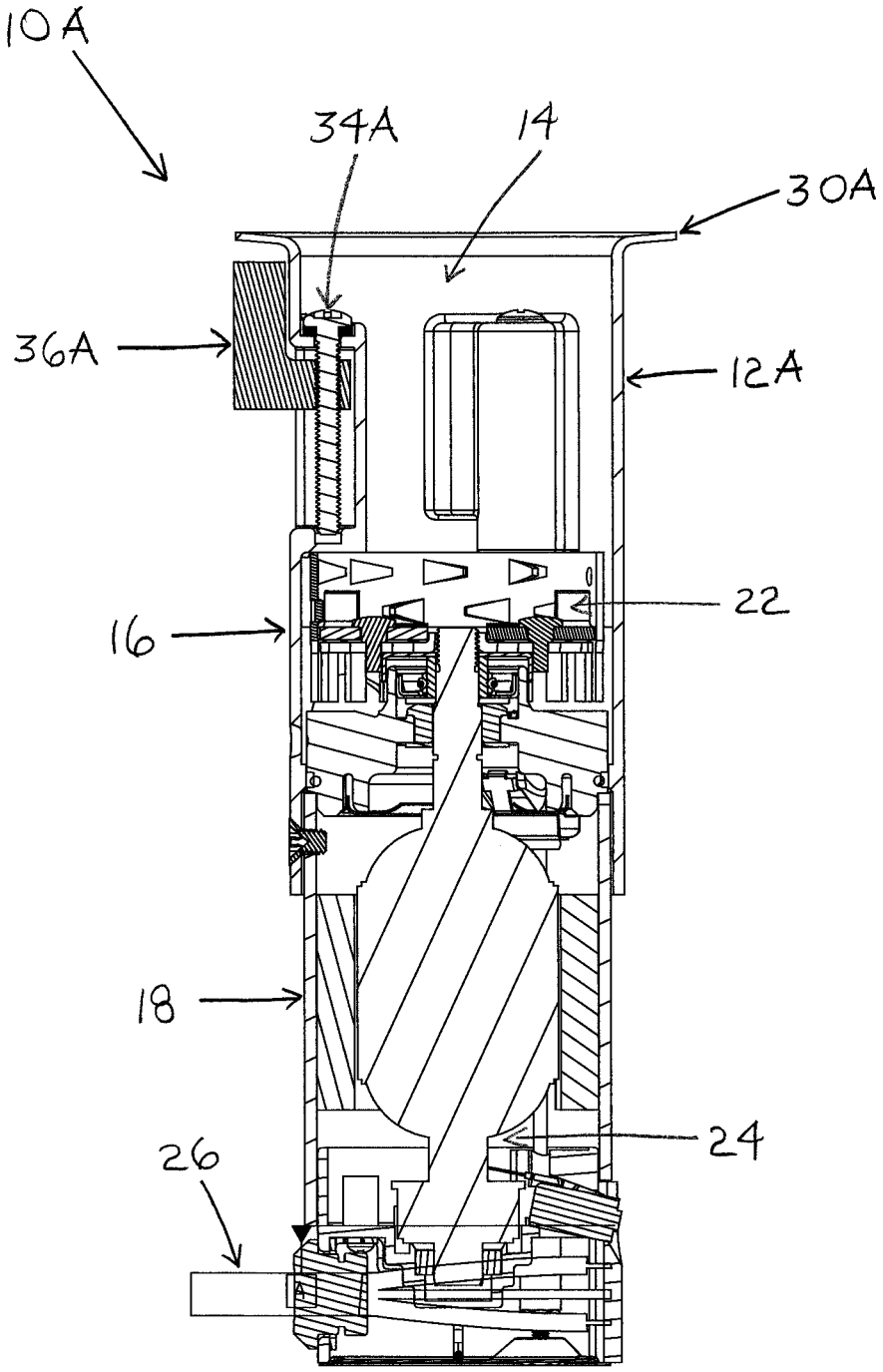

The present invention provides a disposal with above sink installation where the disposal can be inserted through a drain opening in a basin from above the basin.

Exemplary embodiments of a disposal 10 with above sink installation of the present invention are shown in detail in FIGS. 1*a*-7. The same reference numbers in combination with different letters (i.e., letters A, B, C, D, and E) will be used to identify the different embodiments (i.e., the embodiments as shown in FIGS. 1*a*-1*e*, 3, 4*a*-4*d*, 6, and 7). A reference number alone will be used to generically identify all embodiments (i.e., embodiments A, B, C, D, and E as shown in FIGS. 1*a*-1*e*, 3, 4*a*-4*d*, 6, and 7, respectively).

In exemplary embodiments, as shown in FIGS. 1*a*-1*e*, 3, 4*a*-4*d*, 6, and 7, the disposal 10 includes a housing 12. In exemplary embodiments, the housing 12 includes an inlet 14, a grind chamber 16, a motor chamber 18, and an outlet 20. The inlet 14 is operable to fluidly connect to a basin B (e.g., a sink). The basin B includes a floor having a drain opening D extending therethrough. The floor has a top surface and a bottom surface. The inlet 14 is operable to receive water and waste materials from the basin B through the drain opening D. The grind chamber 16 is in fluid communication with the inlet 14. The grind chamber 16 is operable to receive water and waste materials from the inlet 14. The outlet 20 is in fluid communication with the grind chamber 16. The outlet 20 is operable to receive water and waste materials from the grind chamber 16. The outlet 20 is operable to fluidly connect to an outlet pipe P of a sewer system. The outlet 20 is operable to deliver water and waste materials from the grind chamber 16 to the outlet pipe P. During use of the disposal 10, water and waste materials flow from the basin B through the drain opening D, the inlet 14, the grind chamber 16, and the outlet 20 and into the outlet pipe P.

In exemplary embodiments, as shown in FIGS. 1*a*-1*e*, 3, 4*a*-4*d*, 6, and 7, the disposal 10 further includes a grind assembly 22, a motor assembly 24, a power cord 26, and a mount assembly 28. The grind assembly 22 is located in the grind chamber 16. The grind assembly 22 is operable to grind waste materials in the grind chamber 16. The motor assembly 24 is located in the motor chamber 18. The motor assembly 24 is operable to drive the grind assembly 22. The power cord 26 enables the disposal 10 to be electrically connected to a power source. The mount assembly 28 is operable to mount the housing 12 to the drain opening D in the basin B.

Most of these components of disposals are well-known in the art and will not be described in greater detail. Only the mount assembly 28 and related components will be described in greater detail.

In exemplary embodiments, as shown in FIGS. 1*a*-1*e*, 3, 4*a*-4*d*, 6, and 7, the mount assembly 28 includes a flange 30 and a securing mechanism 32. In exemplary embodiments, the flange 30 extends around a portion of the inlet 14 of the housing 12. In the illustrated embodiments, the flange 30 extends completely around the inlet 14 of the housing 12. The flange 30 is operable to abut or be connected to a portion of the top surface of the floor of the basin B. In exemplary embodiments, a portion of the securing mechanism 32 is operable to extend around a portion of an outer surface of the housing 12. In some of the illustrated embodiments, the securing mechanism 32 is operable to extend completely around the outer surface of the housing 12. In exemplary embodiments, a portion of the securing mechanism 32 is operable to abut or be connected to a portion of the bottom surface of the floor of the basin B. In some of the illustrated embodiments, the securing mechanism 32 is operable to completely abut or be connected to a portion of the bottom surface of the floor of the basin B. A diameter of the outer surface of the housing 12 is less than a diameter of the drain opening D in the basin B. In exemplary embodiments, the diameter of the outer surface of the housing 12 is less than 3.5 inches. The housing 12 is operable to be inserted through the drain opening D in the basin B from the top surface of the floor of the basin B. The housing 12 is operable to be secured to the drain opening D in the basin B from the bottom surface of the floor of the basin B.

In exemplary embodiments, as shown in FIGS. 1*a*-1*e* and 3, the securing mechanism 32 includes a fastener 34 and an arm 36. The fastener 34 is operable to move or be moved (e.g., spring, expand, contract, be rotated, be pulled, or be pushed). In exemplary embodiments, the fastener 34 extends through an upper portion of the housing 12. In exemplary embodiments, the fastener 34 has a first end 38 and a second end 40. In exemplary embodiments, the first end 38 of the fastener 34 is accessible through the inlet 14 of the housing 12. The arm 36 is operable to be moved. The arm 36 is operable to be connected to the fastener 34. In exemplary embodiments, the arm 36 has a first end 42 and a second end 44. In exemplary embodiments, the first end 42 of the arm 36 is operable to be connected to the second end 40 of the fastener 34. When the fastener 34 moves or is moved, the arm 36 moves until the second end 44 of the arm 36 abuts or is connected to a portion of the bottom surface of the floor of the basin B. The housing 12 is operable to be secured to the drain opening D in the basin B when the second end 44 of the arm 36 abuts or is connected to the bottom surface of the floor of the basin B.

In an exemplary embodiment, as shown in FIGS. 1*a*-1*e*, the securing mechanism 32A includes a threaded fastener 34A and an arm 36A. The threaded fastener 34A includes a first end 38A and a second end 40A. The threaded fastener 34A extends through an upper portion of the housing 12A. The threaded fastener 34A is operable to be rotated. The arm 36A includes a first portion 46A having a first end 42A and a second portion 48A having a second end 44A. In the illustrated embodiment, the arm 36A is generally L-shaped. The first end 42A of the first portion 46A of the arm 36A includes an opening 50A. The opening 50A in the first end 42A of the first portion 46A of the arm 36A is operable to receive the threaded fastener 34A. When the threaded fastener 34A is rotated, the arm 36A rotates outwardly and then moves upwardly along the threaded fastener 34A until the second end 44A of the second portion 48A of the arm 36A abuts a portion of the bottom surface of the floor of the basin B. The housing 12A is operable to be secured to the drain opening D in the basin B when the second end 44A of the second portion 48A of the arm 36A abuts the bottom surface of the floor of the basin B.

In the exemplary embodiment, as shown in FIGS. 1*a*-1*e*, the upper portion of the housing 12A includes a ledge 52A through which the threaded fastener 34A extends. The first end 38A (i.e., a head) of the threaded fastener 34A abuts the ledge 52A of the upper portion of the housing 12A. The housing 12A includes an opening 54A through which the first portion 46A of the arm 36A extends. Prior to installation, the arm 36A extends in the opening 54A in the housing 12A such that the arm 36A is generally flush with an outer surface of the housing 12A. During installation, as the threaded fastener 34A is rotated, the arm 36A rotates so that the first portion 46A of the arm 36A extends through the opening 54A in the housing 12A and the second portion 48A of the arm 36A is outside the housing 12A. As the arm 36A rotates, the first portion 46A of the arm 36A abuts an edge of the opening 54A in the housing 12A causing the arm 36A to stop rotating. As the threaded fastener 34A is further rotated, the first portion 46A of the arm 36A moves upwardly until the second end 44A of the second portion 48A of the arm 36A abuts the bottom surface of the floor of the basin B.

In an exemplary embodiment, as shown in FIGS. 1*a*-1*e*, the securing mechanism 32A includes a plurality of threaded fasteners 34A and a plurality of arms 36A. In the illustrated embodiment, the securing mechanism 32A includes three threaded fasteners 34A and three arms 36A. In an exemplary embodiment, the threaded fasteners 34A are spaced around an inner periphery of the inlet 14 of the housing 12A. In the illustrated embodiment, the threaded fasteners 34A are generally evenly spaced around the inner periphery of the inlet 14 of the housing 12A. In an exemplary embodiment, the arms 36A are spaced around an outer periphery of the housing 12A. In the illustrated embodiment, the arms 36A are generally evenly spaced around the outer periphery of the housing 12A.

Figure 2A:
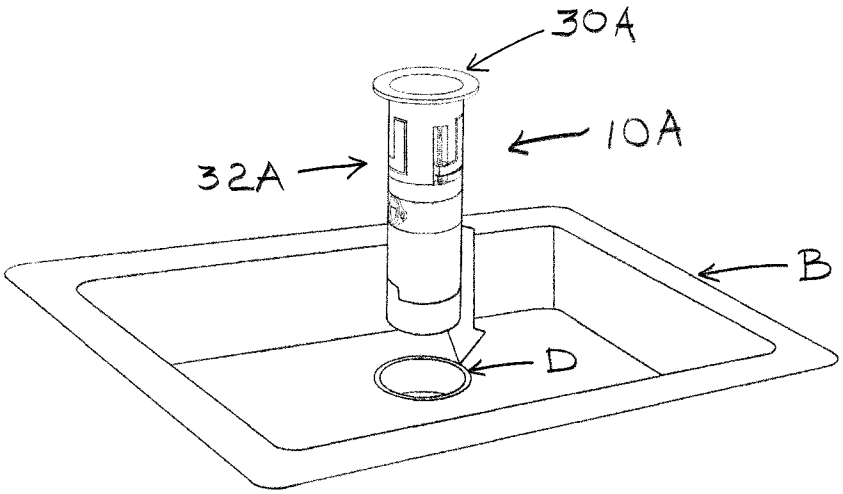
FIGS. 2*a*-2*c* are schematic illustrations of installation steps for the disposal of FIGS. 1*a*-1*e;*
Figure 2B:
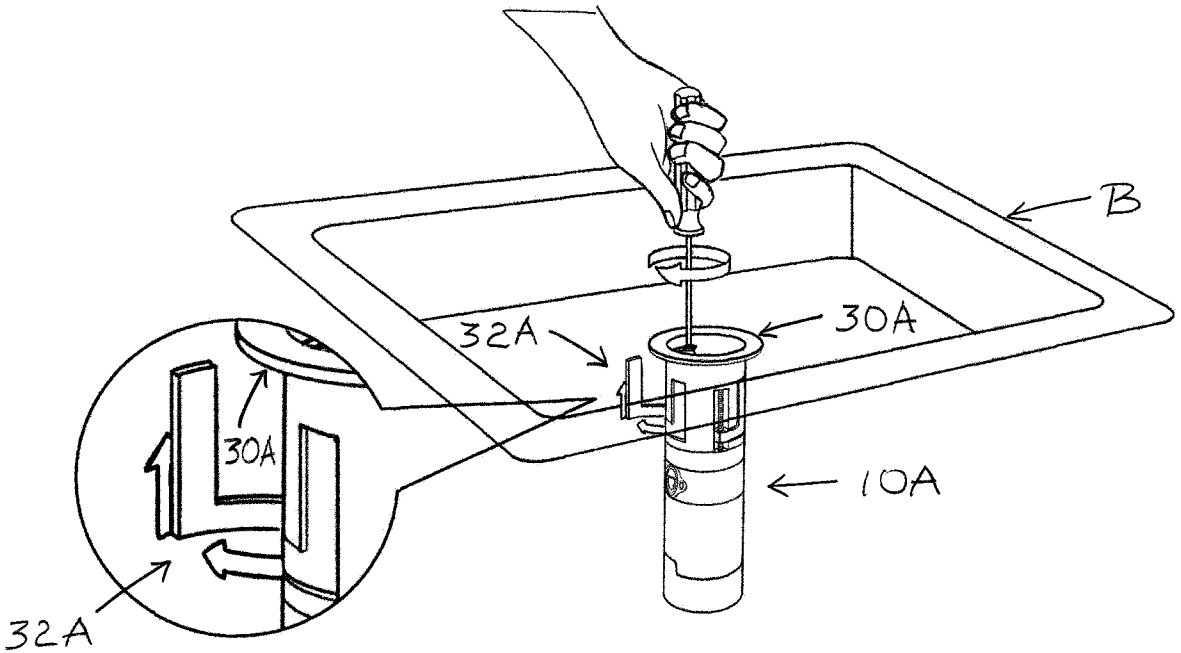
Figure 2C:
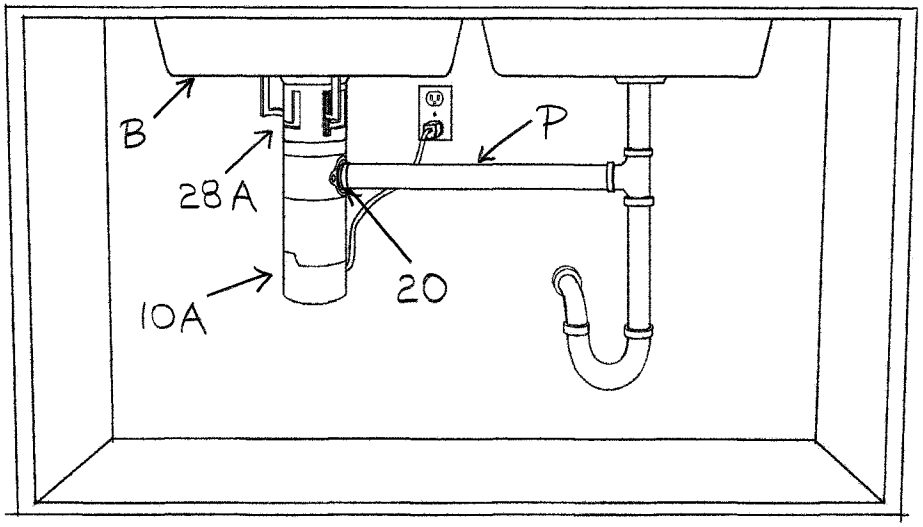

Exemplary installation steps of the disposal of FIGS. 1*a*-1*e* are shown in FIGS. 2*a*-2*c*. The housing 12A is inserted through the drain opening D in the basin B from the top surface of the floor of the basin B (see FIG. 2*a*). Each of the threaded fasteners 34A is rotated causing the corresponding arm 36A to rotate so that the first portion 46A of the arm 36A extends through the corresponding opening 54A in the housing 12A and the second portion 48A of the arm 36A is outside the housing 12A (see FIG. 2*b*). As the arm 36A rotates, the first portion 46A of the arm 36A abuts the edge of the opening 54A in the housing 12A causing the arm 36A to stop rotating (see FIG. 2*b*). As the threaded fastener 34A is further rotated, the first portion 46A of the arm 36A moves upwardly until the second end 44A of the second portion 48A of the arm 36A abuts the bottom surface of the floor of the basin B (see FIG. 2*c*). As a result, the housing 12A is secured to the drain opening D in the basin B from the bottom surface of the floor of the basin B (see FIG. 2*c*).

Figure 3:
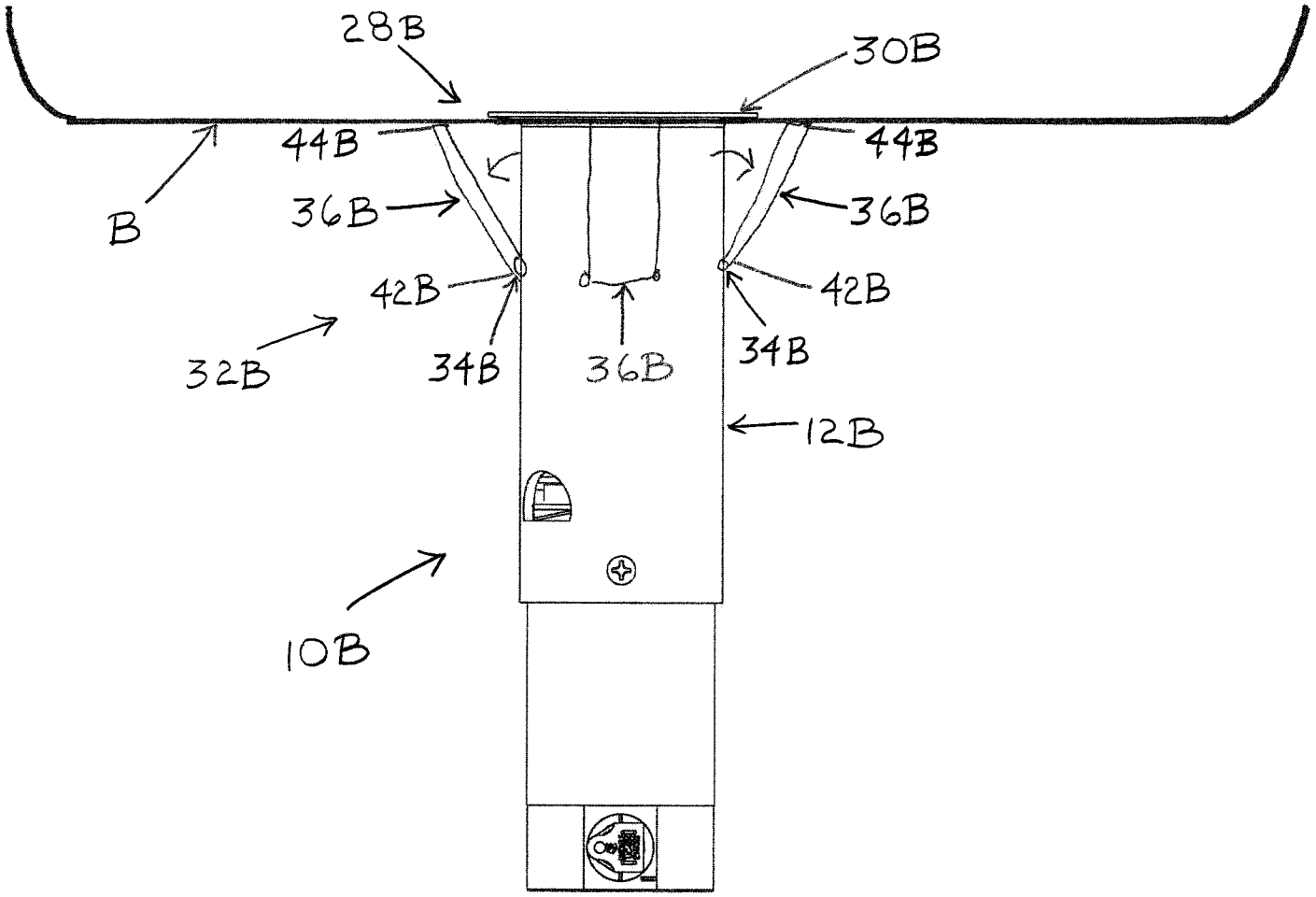
FIG. 3 is a rear elevational view of a disposal with above sink installation according to a second exemplary embodiment of the present invention.
Figure 4B:
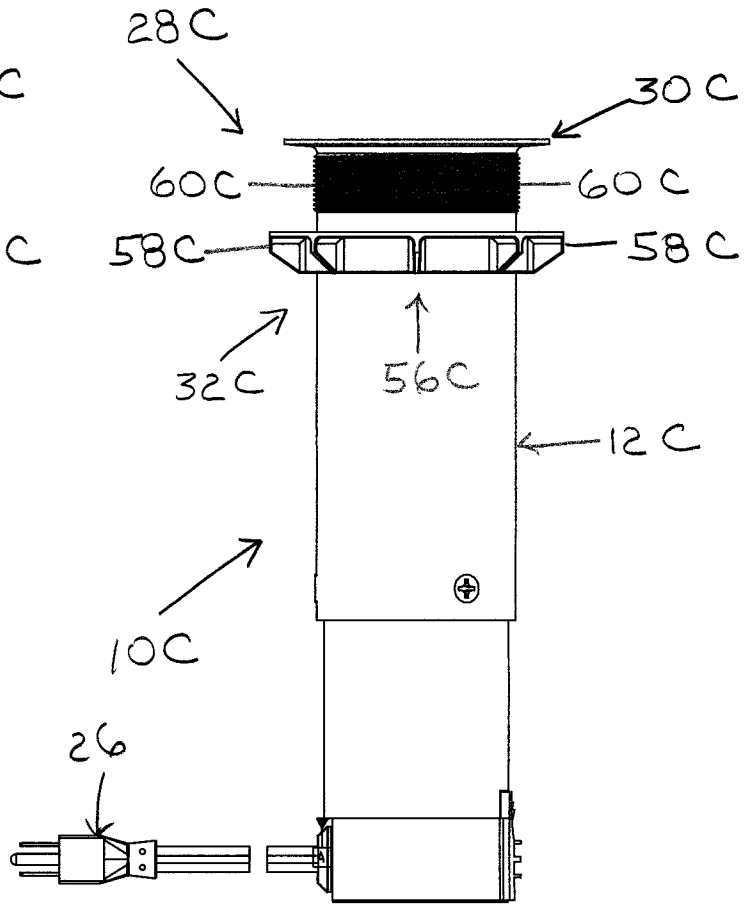
FIGS. 4*a*-4*d* are views of a disposal with above sink installation according to a third exemplary embodiment of the present invention
Figure 4A:
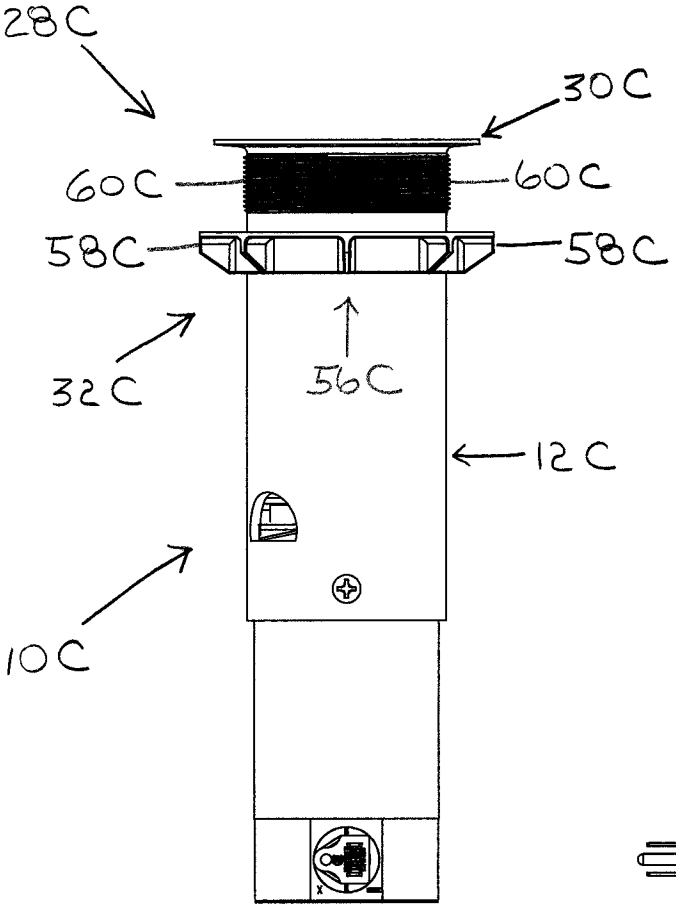
Figure 4D:
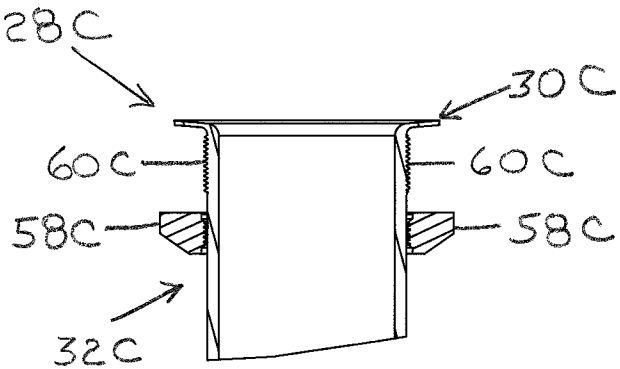
Figure 4C:
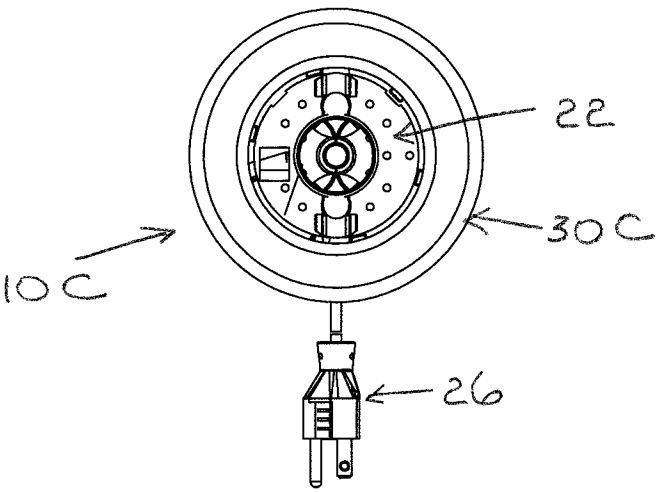
Figure 5A:
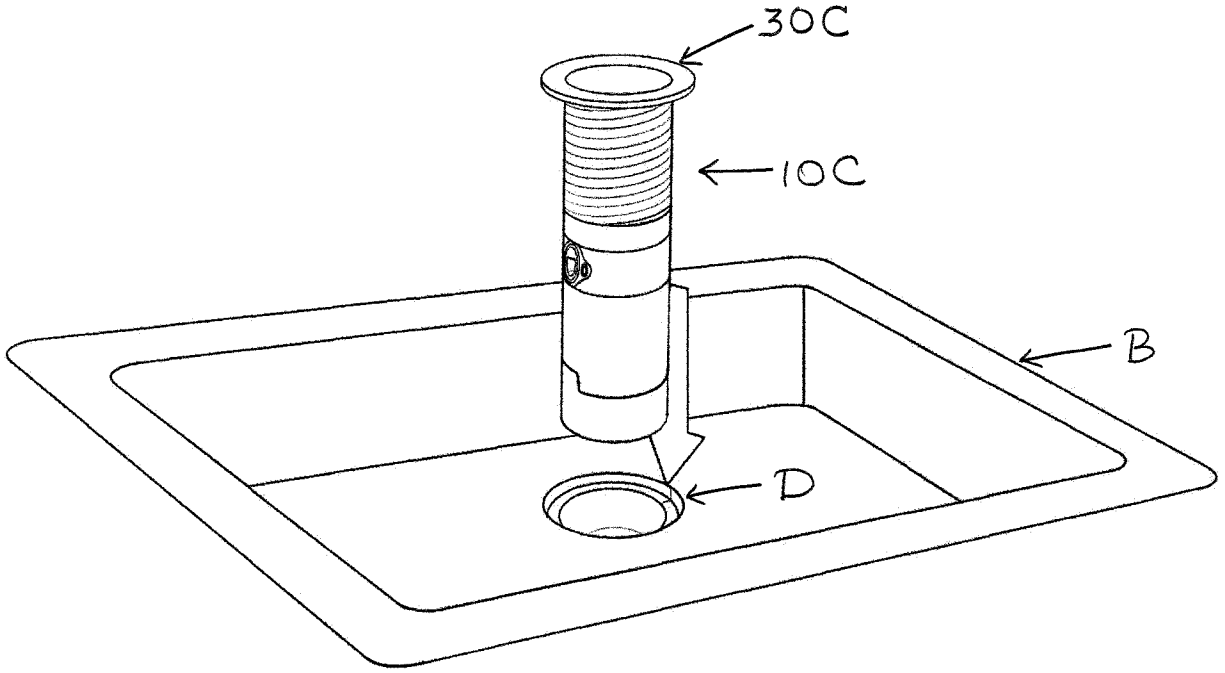
FIGS. 5*a*-5*d* are schematic illustrations of installation steps for the disposal of FIGS. 4*a*-4*d;*
Figure 5B:
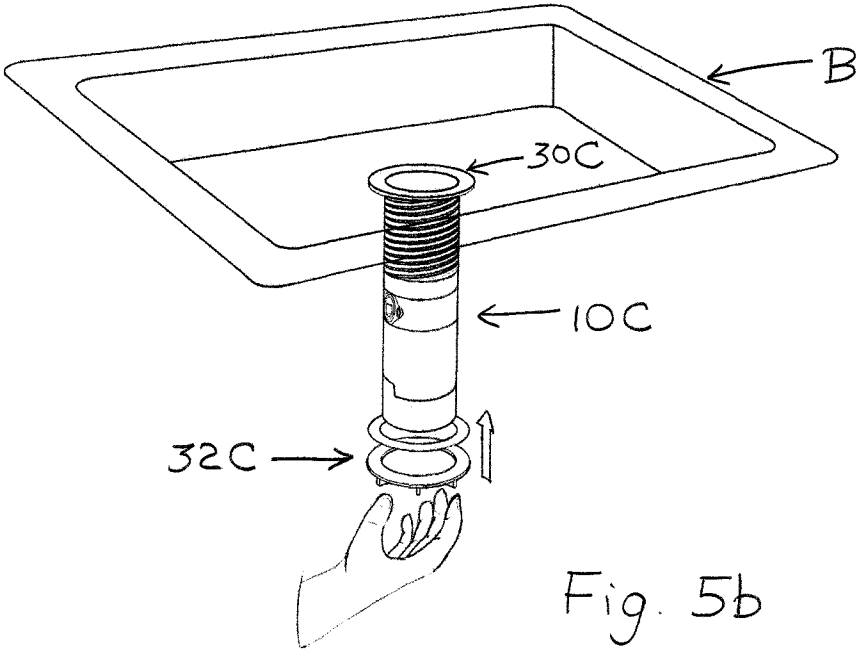
Figure 5C:
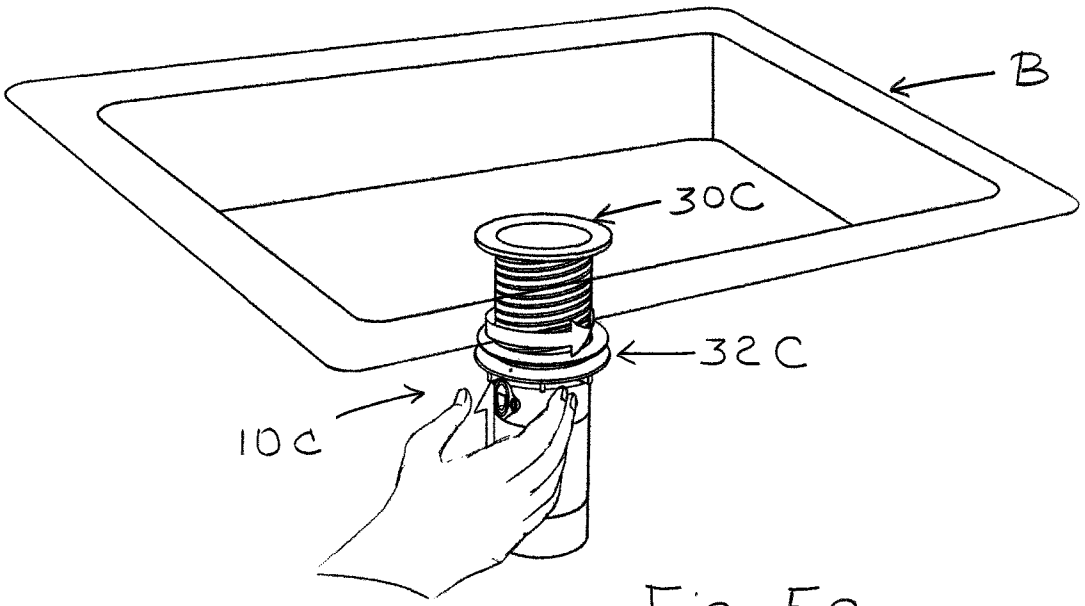
Figure 5D:
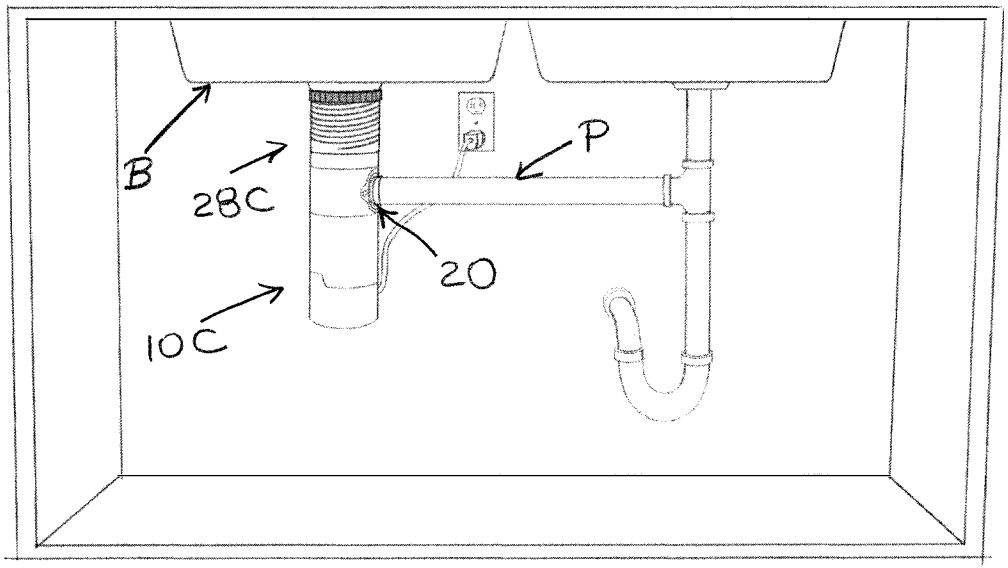

In an exemplary embodiment, as shown in FIG. 3, the securing mechanism 32B includes a spring fastener 34B and an arm 36B. The spring fastener 34B is operable to move. The arm 36B has a first end 42B and a second end 44B. The first end 42B of the arm 36B is operable to be connected to the spring fastener 34B. When the spring fastener 34B moves, the arm 36B moves until the second end 44B of the arm 36B abuts a portion of the bottom surface of the floor of the basin B. The housing 12B is operable to be secured to the drain opening D in the basin B when the second end 44B of the arm 34B abuts the bottom surface of the floor of the basin B.

In an exemplary embodiment, as shown in FIG. 3, the securing mechanism 32B includes a plurality of spring fasteners 34B and a plurality of arms 36B. In the illustrated embodiment, the securing mechanism 32B includes four spring fasteners 34B and four arms 36B. In an exemplary embodiment, the spring fasteners 34B are spaced around an outer periphery of the housing 12B. In the illustrated embodiment, the spring fasteners 34B are generally evenly spaced around the outer periphery of the housing 12B. In an exemplary embodiment, the arms 36B are spaced around the outer periphery of the housing 12B. In the illustrated embodiment, the arms 36B are generally evenly spaced around the outer periphery of the housing 12B.

Exemplary installation steps of the disposal of FIG. 3 will be described. The arms 36B are held against the housing 12B (e.g., by a user). The housing 12B is inserted through the drain opening D in the basin B from the top surface of the floor of the basin B. Once the arms 36B are below the bottom surface of the floor of the basin B, the spring fasteners 34B will move by spring force causing the corresponding arms 36B to move until the second end 44B of each arm 36B abuts the bottom surface of the floor of the basin B. As a result, the housing 12B is secured to the drain opening D in the basin B from the bottom surface of the floor of the basin B.

In exemplary embodiments, as shown in FIGS. 4*a*-4*d*, 6, and 7, the securing mechanism 32 includes a ring 56. In exemplary embodiments, the ring 56 is operable to extend around a portion of an outer surface of the housing 12. In the illustrated embodiments, the ring 56 is operable to extend completely around the outer surface of the housing 12. In exemplary embodiments, a portion of the ring 56 is operable to abut or be connected to a portion of the bottom surface of the floor of the basin B. In some of the illustrated embodiments, the ring 56 is operable to completely abut or be connected to a portion of the bottom surface of the floor of the basin B. The housing 12 is operable to be secured to the drain opening D in the basin B when a portion of the ring 56 abuts or is connected to a portion of the bottom surface of the floor of the basin B.

As used herein, the ring 56 is any device that is operable to extend around a portion of the outer surface of the housing 12. Such device is not limited to being circular in shape, although it may be and is in the illustrated embodiments.

Moreover, such device is not limited to being a closed shape, although it may be and is in the illustrated embodiments.

In an exemplary embodiment, as shown in FIGS. 4*a*-4*d*, the securing mechanism 32C includes a nut 58C. In the illustrated embodiment, an inner surface of the nut 58C is generally circular shaped. The housing 12C includes a threaded outer surface 60C. In the illustrated embodiment, the threaded outer surface 60C of the housing 12C is generally circular shaped. The nut 58C is operable to be threaded onto the threaded outer surface 60C of the housing 12C until the nut 58C abuts a portion of the bottom surface of the floor of the basin B. In an exemplary embodiment, a washer (not shown) is provided between the nut 58C and the bottom surface of the floor of the basin B. The housing 12C is operable to be secured to the drain opening D in the basin B when the nut 58C abuts a portion of the bottom surface of the floor of the basin B.

Exemplary installation steps of the disposal of FIGS. 1*a*-1*e* are shown in FIGS. 5*a*-5*d*. The housing 12C is inserted through the drain opening D in the basin B from the top surface of the floor of the basin B (see FIG. 5*a*). The nut 58C is slid over the housing 12C from a bottom portion of the housing 12C (see FIG. 5*b*). The nut 58C is threaded onto the threaded outer surface 60C of the housing 12C (see FIG. 5*c*) until the nut 58C abuts a portion of the bottom surface of the floor of the basin B (see FIG. 5*d*). As a result, the housing 12C is secured to the drain opening D in the basin B from the bottom surface of the floor of the basin B (see FIG. 5*d*).

Figure 6:
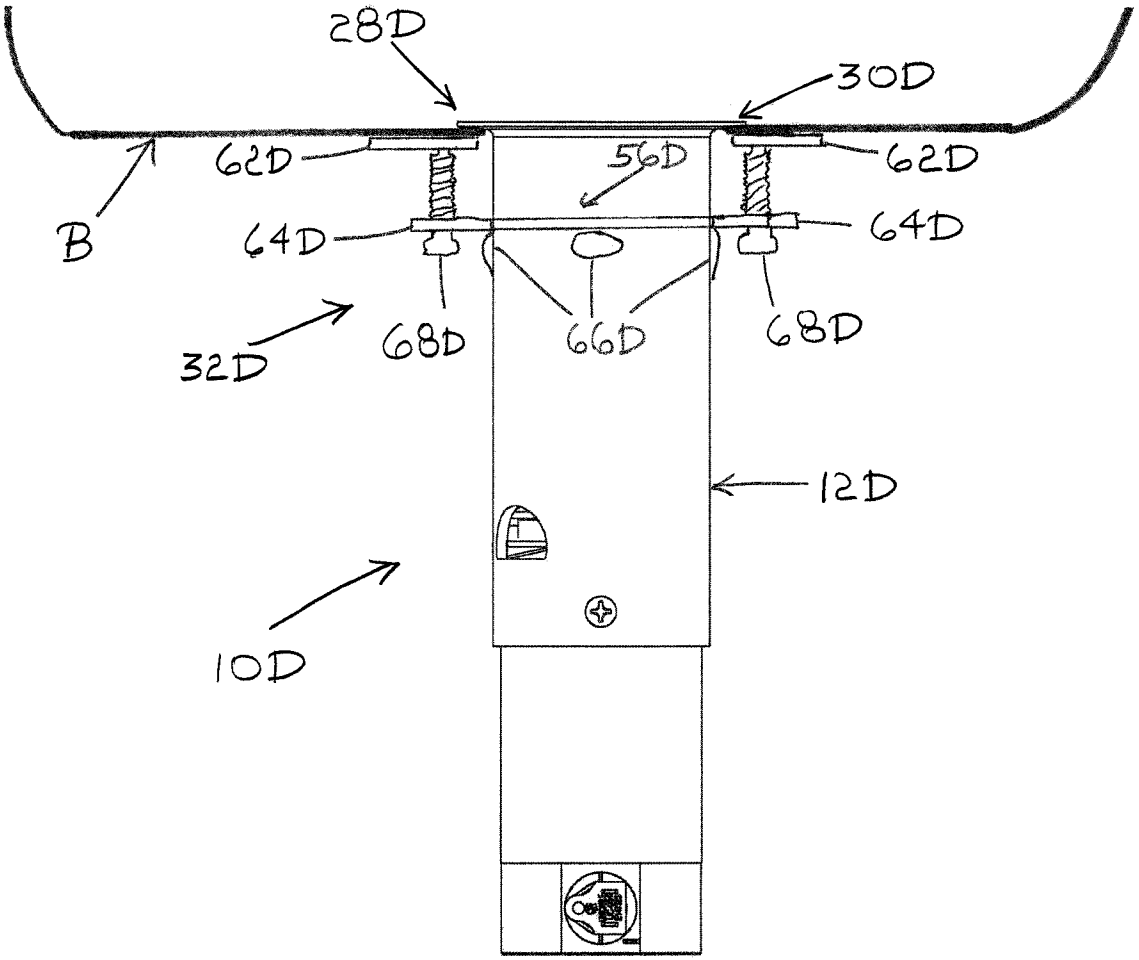
FIG. 6 is a rear elevational view of a disposal with above sink installation according to a fourth exemplary embodiment of the present invention.

In an exemplary embodiment, as shown in FIG. 6, the securing mechanism 32D includes an upper plate 62D, a lower plate 64D, a projection 66D, and a fastener 68D. The upper plate 62D and the lower plate 64D are operable to extend around an outer surface of the housing 12D. The projection 66D extends outwardly from the outer surface of the housing 12D. The upper plate 62D and the lower plate 64D are operable to be slid along the outer surface of the housing 12D above the projection 66D. The upper plate 62D is operable to abut a portion of the bottom surface of the floor of the basin B. The lower plate 64D is operable to abut the projection 66D. The fastener 68D is operable to extend through the lower plate 62D and into the upper plate 64D. The housing 12D is operable to be secured to the drain opening D in the basin B when the upper plate 62D abuts a portion of the bottom surface of the floor of the basin B, the lower plate abuts the projection 66D, and the fastener 68D extends through the lower plate 62D and into the upper plate 64D.

In an exemplary embodiment, as shown in FIG. 6, the securing mechanism 32D includes a plurality of projections 66D and a plurality of fasteners 68D. In the illustrated embodiment, the securing mechanism 32D includes four projections 66D and two fasteners 68D. In an exemplary embodiment, the projections 66D are spaced around an outer periphery of the housing 12D. In the illustrated embodiment, the projections 66D are generally evenly spaced around the outer periphery of the housing 12D. In an exemplary embodiment, the fasteners 68D are spaced around the outer periphery of the housing 12D. In the illustrated embodiment, the fasteners 68D are generally evenly spaced around the outer periphery of the housing 12D.

Figure 7:
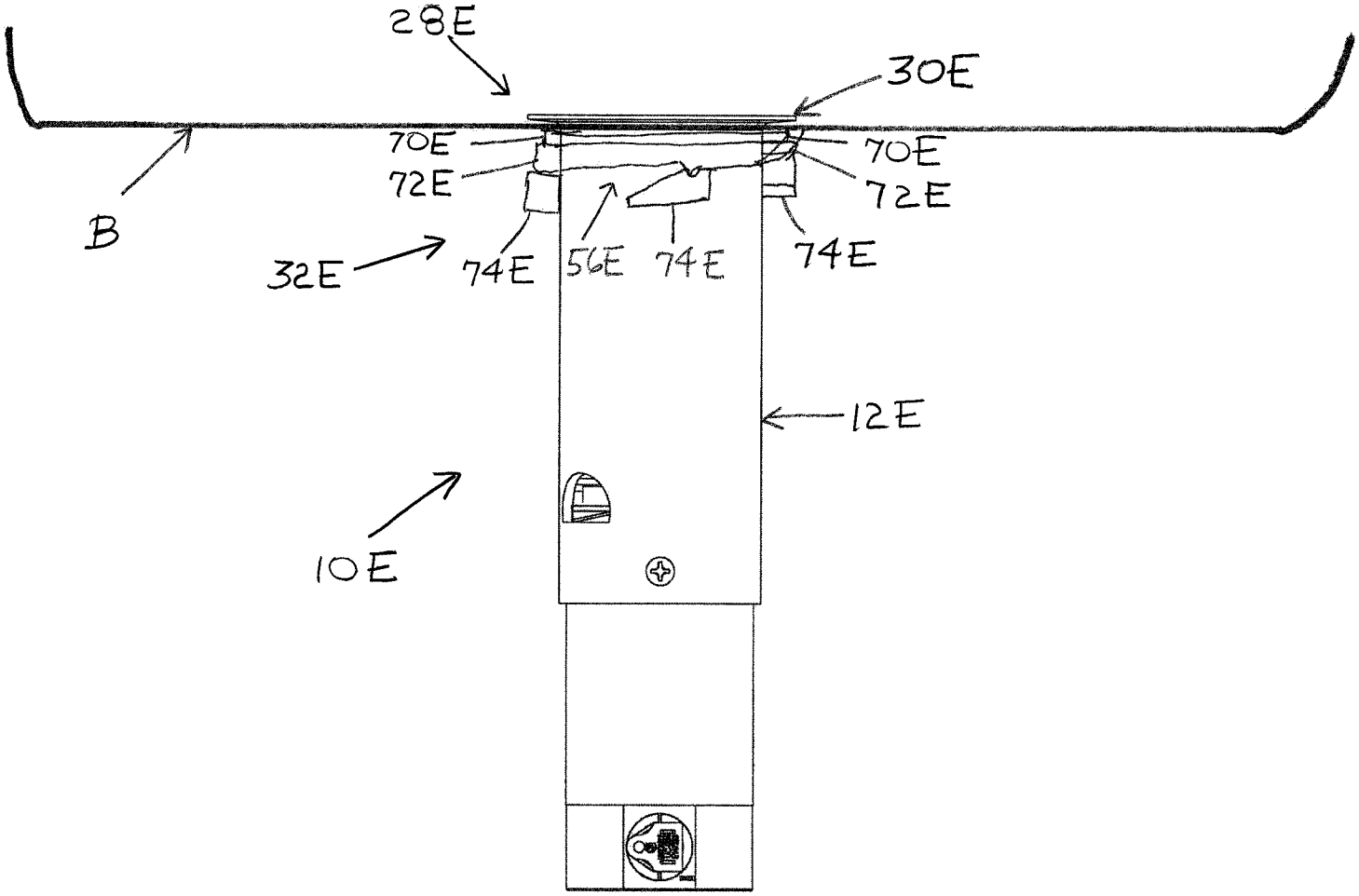
FIG. 7 is a rear elevational view of a disposal with above sink installation according to a fifth exemplary embodiment of the present invention.

In an exemplary embodiment, as shown in FIG. 7, the securing mechanism 32E includes a gasket 70E, a collar 72E, and a ramp 74E. In exemplary embodiments, a spring, a wavy washer, or a lock washer (none shown) are provided instead of the gasket 70E. The gasket 70E is operable to extend around an outer surface of the housing 12E. The gasket 70E is operable to abut a portion of the bottom surface of the floor of the basin B. The gasket 70E is operable to be compressed. The collar 72E is operable to extend around the outer surface of the housing 12E. The ramp 74E extends outwardly from the outer surface of the housing 12E. The collar 72E is operable to be moved along the outer surface of the housing 12E and ride up the ramp 74E until the collar 72E abuts and compresses a portion of the gasket 70E. The housing 12E is operable to be secured to the drain opening D in the basin B when the collar 72E abuts and compresses a portion of the gasket 70E and the gasket 70E abuts a portion of the bottom surface of the floor of the basin B.

In an exemplary embodiment, as shown in FIG. 7, the securing mechanism 32E includes a plurality of ramps 74E. In the illustrated embodiment, the securing mechanism 32D includes four ramps 74E. In an exemplary embodiment, the ramps 74E are spaced around an outer periphery of the housing 12E. In the illustrated embodiment, the ramps 74E are generally evenly spaced around the outer periphery of the housing 12E.

While the disposal has been shown and described in the illustrated embodiments as including certain components, one of ordinary skill in the art will appreciate that the disposal does not need to include each of these components and/or the specifics of each of these components.

Additionally, as used herein, "a portion" of a component could be any portion of the component, including the entire component.

Further, as used herein, when a component is operable to "move or be moved" or "moves or is moved," the movement could be caused by the component itself (e.g., a spring-like action moving the component) or by an external force (e.g., a user moving the component).

Moreover, as used herein, when one component is operable to "abut" or "be connected to" another component, the components may be in direct contact, indirect contact, directly connected, or indirectly connected (i.e., there may be one or more other components between the abutting or connected components).

One of ordinary skill in the art will now appreciate that the present invention provides a disposal with above sink installation where the disposal can be inserted through a drain opening in a basin from above the basin. Although the present invention has been shown and described with reference to particular embodiments, equivalent alterations and modifications will occur to those skilled in the art upon reading and understanding this specification. The present invention includes all such equivalent alterations and modifications.

What is claimed is:

1. A disposal, comprising:

a housing, the housing including an inlet, a grind chamber, a motor chamber, and an outlet, the inlet being operable to fluidly connect to a basin, the basin including a floor having a drain opening extending therethrough, the floor having a top surface and a bottom surface, the inlet being operable to receive water and waste materials from the basin through the drain opening, the grind chamber being in fluid communication with the inlet, the grind chamber being operable to receive water and waste materials from the inlet, the outlet being in fluid communication with the grind chamber, the outlet being operable to receive water and waste materials from the grind chamber, the outlet being operable to fluidly connect to an outlet pipe of a sewer system, the outlet being operable to deliver water and waste materials from the grind chamber to the outlet pipe;

a grind assembly, the grind assembly being located in the grind chamber, the grind assembly being operable to grind waste materials in the grind chamber;

a motor assembly, the motor assembly being located in the motor chamber, the motor assembly being operable to drive the grind assembly;

a mount assembly, the mount assembly being operable to mount the housing to the drain opening in the basin, the mount assembly including a flange and a securing mechanism;

wherein the flange extends around a portion of the inlet of the housing, and the flange is operable to abut or be connected to a portion of the top surface of the floor of the basin;

wherein a first portion of the securing mechanism is operable to extend around a portion of an outer surface of the housing, and the first portion of the securing mechanism is operable to abut or be connected to a portion of the bottom surface of the floor of the basin;

wherein a diameter of the outer surface of the housing is less than a diameter of the drain opening in the basin;

wherein the housing is operable to be inserted through the drain opening in the basin from the top surface of the floor of the basin;

wherein the housing is operable to be secured to the drain opening in the basin from the bottom surface of the floor of the basin.

2. The disposal of claim 1, wherein a diameter of the housing is less than 3.5 inches.

3. The disposal of claim 1, wherein the first portion of the securing mechanism is operable to be moved until the first portion of the securing mechanism abuts or is connected to the portion of the bottom surface of the floor of the basin.

4. The disposal of claim 1, wherein:

the first portion of the securing mechanism is operable to be moved;

a second portion of the securing mechanism is operable to be connected to the first portion of the securing mechanism;

the second portion of the securing mechanism is operable to move or be moved;

when the second portion of the securing mechanism moves or is moved, the first portion of the securing mechanism moves until the first portion of the securing mechanism abuts or is connected to the portion of the bottom surface of the floor of the basin.

5. The disposal of claim 1, wherein:

the first portion of the securing mechanism is operable to be moved;

a second portion of the securing mechanism extends through an upper portion of the housing;

the second portion of the securing mechanism is accessible through the inlet of the housing;

the second portion of the securing mechanism is operable to be connected to the first portion of the securing mechanism;

the second portion of the securing mechanism is operable to be moved through the inlet of the housing;

when the second portion of the securing mechanism moves or is moved, the first portion of the securing mechanism moves until the first portion of the securing mechanism abuts or is connected to the portion of the bottom surface of the floor of the basin.

6. The disposal of claim 1, wherein:

the securing mechanism includes an arm;

the arm is operable to be moved until a portion of the arm abuts or is connected to the portion of the bottom surface of the floor of the basin.

7. The disposal of claim 6, wherein:

the securing mechanism further includes a fastener;

the arm is operable to be connected to the fastener;

the fastener is operable to move or be moved;

when the fastener moves or is moved, the arm moves until the portion of the arm abuts or is connected to the portion of the bottom surface of the floor of the basin.

8. The disposal of claim 1, wherein:

the securing mechanism includes a ring;

the ring is operable to be moved until a portion of the ring abuts or is connected to the portion of the bottom surface of the floor of the basin.

9. A disposal, comprising:

a housing, the housing including an inlet, a grind chamber, a motor chamber, and an outlet, the inlet being operable to fluidly connect to a basin, the basin including a floor having a drain opening extending therethrough, the floor having a top surface and a bottom surface, the inlet being operable to receive water and waste materials from the basin through the drain opening, the grind chamber being in fluid communication with the inlet, the grind chamber being operable to receive water and waste materials from the inlet, the outlet being in fluid communication with the grind chamber, the outlet being operable to receive water and waste materials from the grind chamber, the outlet being operable to fluidly connect to an outlet pipe of a sewer system, the outlet being operable to deliver water and waste materials from the grind chamber to the outlet pipe;

a grind assembly, the grind assembly being located in the grind chamber, the grind assembly being operable to grind waste materials in the grind chamber;

a motor assembly, the motor assembly being located in the motor chamber, the motor assembly being operable to drive the grind assembly;

a mount assembly, the mount assembly being operable to mount the housing to the drain opening in the basin, the mount assembly including a flange, a fastener, and an arm;

wherein the flange extends around a portion of the inlet of the housing, and the flange is operable to abut or be connected to a portion of the top surface of the floor of the basin;

wherein the fastener is operable to move or be moved;

wherein the arm is operable to be moved, the arm has a first end and a second end, and the first end of the arm is operable to be connected to the fastener;

wherein when the fastener moves or is moved, the first end of the arm moves until the second end of the arm abuts or is connected to a portion of the bottom surface of the floor of the basin;

wherein a diameter of the outer surface of the housing is less than a diameter of the drain opening in the basin;

wherein the housing is operable to be inserted through the drain opening in the basin from the top surface of the floor of the basin;

wherein the housing is operable to be secured to the drain opening in the basin when the second end of the arm abuts or is connected to the bottom surface of the floor of the basin.

10. The disposal of claim 9, wherein a diameter of the housing is less than 3.5 inches.

11. The disposal of claim 9, wherein the fastener is operable to be rotated or spring.

12. The disposal of claim 9, wherein:

the fastener extends through an upper portion of the housing;

the fastener includes a first end and a second end;

the first end of the fastener is accessible through the inlet of the housing;

the second end of the fastener is operable to be connected to the first end of the arm;

the first end of the fastener is operable to be moved through the inlet of the housing.

13. The disposal of claim 9, wherein:

the fastener is a threaded fastener and is operable to be rotated;

the arm is operable to be rotated and moved upwardly;

when the threaded fastener is rotated, the arm rotates outwardly and then moves upwardly along the threaded fastener until the second end of the arm abuts or is connected to the portion of the bottom surface of the floor of the basin.

14. The disposal of claim 9, wherein:

the fastener is a spring fastener and is operable to move;

the arm is operable to be moved;

when the spring fastener moves, the second end of the arm moves outwardly until the second end of the arm abuts or is connected to the portion of the bottom surface of the floor of the basin.

15. A disposal, comprising:

a housing, the housing including an inlet, a grind chamber, a motor chamber, and an outlet, the inlet being operable to fluidly connect to a basin, the basin including a floor having a drain opening extending therethrough, the floor having a top surface and a bottom surface, the inlet being operable to receive water and waste materials from the basin through the drain opening, the grind chamber being in fluid communication with the inlet, the grind chamber being operable to receive water and waste materials from the inlet, the outlet being in fluid communication with the grind chamber, the outlet being operable to receive water and waste materials from the grind chamber, the outlet being operable to fluidly connect to an outlet pipe of a sewer system, the outlet being operable to deliver water and waste materials from the grind chamber to the outlet pipe;

a grind assembly, the grind assembly being located in the grind chamber, the grind assembly being operable to grind waste materials in the grind chamber;

a motor assembly, the motor assembly being located in the motor chamber, the motor assembly being operable to drive the grind assembly;

a mount assembly, the mount assembly being operable to mount the housing to the drain opening in the basin, the mount assembly including a flange and a ring;

wherein the flange extends around a portion of the inlet of the housing, and the flange is operable to abut or be connected to a portion of the top surface of the floor of the basin;

wherein the ring is operable to extend around a portion of an outer surface of the housing, and a portion of the ring is operable to abut or be connected to a portion of the bottom surface of the floor of the basin;

wherein a diameter of the outer surface of the housing is less than a diameter of the drain opening in the basin;

wherein the housing is operable to be inserted through the drain opening in the basin from the top surface of the floor of the basin;

wherein the housing is operable to be secured to the drain opening in the basin when the ring abuts or is connected to the bottom surface of the floor of the basin.

16. The disposal of claim 15, wherein a diameter of the housing is less than 3.5 inches.

17. The disposal of claim 15, wherein the ring is generally circular shaped.

18. The disposal of claim 15, wherein:

the housing includes a threaded outer surface;

the ring is a nut;

the nut is operable to be threaded onto the threaded outer surface of the housing until the nut abuts or is connected to the portion of the bottom surface of the floor of the basin.

19. The disposal of claim 15, wherein:

the ring includes an upper plate and a lower plate;

the securing mechanism further includes a projection and a fastener;

the upper plate and the lower plate are operable to substantially extend around the portion of the outer surface of the housing;

the projection extends outwardly from the outer surface of the housing;

the upper plate and the lower plate are operable to be slid along the outer surface of the housing above the projection;

the upper plate is operable to abut or be connected to the portion of the bottom surface of the floor of the basin;

the lower plate is operable to abut or be connected to the projection;

the fastener is operable to extend through the lower plate and into the upper plate.

20. The disposal of claim 15, wherein the ring includes a collar and the securing mechanism further includes a gasket and a ramp;

the gasket is operable to substantially extend around an outer surface of the housing and to be compressed;

the collar is operable to substantially extend around an outer surface of the housing;

the ramp extends outwardly from the outer surface of the housing;

the collar is operable to be moved along the outer surface of the housing and ride up the ramp until the collar abuts or is connected to and compresses a portion of the gasket.

* * * * *